United States Patent [19]

Baynes et al.

[11] Patent Number: 5,050,731

[45] Date of Patent: Sep. 24, 1991

[54] PACKAGING SYSTEM FOR PRE-ASSEMBLED GAS BARBEQUE GRILL

[75] Inventors: William R. Baynes; Henry C. Schubert, both of Perry, Ill.

[73] Assignee: Charmglow Industries, Inc., DuQuoin, Ill.

[21] Appl. No.: 557,317

[22] Filed: Jul. 23, 1990

[51] Int. Cl.[5] ..... B65D 85/00

[52] U.S. Cl. ..... 206/320; 206/326; 206/586; 206/592

[58] Field of Search ..... 206/320, 525, 521, 586, 206/591, 592, 326; 126/41 R, 39 R, 25 R

[56] References Cited

U.S. PATENT DOCUMENTS

| | | | |
|---|---|---|---|
| 1,817,286 | 8/1931 | Beaman | 206/592 X |
| 2,340,387 | 2/1944 | Hummel | 206/320 X |
| 2,370,749 | 3/1945 | Perkins | 206/320 |
| 2,474,968 | 7/1949 | Beach, Jr. | 206/320 |
| 2,575,784 | 11/1951 | Baumann | 206/320 |
| 2,753,101 | 7/1956 | Zimmerman | 206/320 X |
| 2,783,930 | 3/1957 | Riley | 206/320 X |
| 2,895,695 | 7/1959 | Solomon | 206/320 X |
| 2,906,445 | 9/1959 | Tabakof et al. | 206/592 X |
| 2,960,217 | 11/1960 | Nason | 206/320 |
| 3,192,680 | 7/1965 | Mantell et al. | 206/592 X |
| 3,414,121 | 12/1968 | Suzuki | 206/320 |
| 3,661,318 | 5/1972 | Miller et al. | 206/521 X |
| 4,117,929 | 10/1978 | Van der May | 206/326 |
| 4,741,321 | 5/1988 | Squires | 126/41 R X |
| 4,836,379 | 6/1989 | Shaw | 206/586 X |
| 4,851,286 | 7/1989 | Maurice | 206/586 X |
| 4,881,641 | 11/1989 | Mattingly et al. | 206/320 |
| 4,896,652 | 1/1990 | Geiter | 126/41 R |

FOREIGN PATENT DOCUMENTS

| | | | |
|---|---|---|---|
| 0273237 | 11/1989 | Fed. Rep. of Germany | 206/320 |
| 713655 | 9/1966 | Italy | 206/320 |
| 491533 | 9/1938 | United Kingdom | 206/320 |

*Primary Examiner*—Bryon P. Gehman

*Attorney, Agent, or Firm*—Polster, Polster and Lucchesi

[57] ABSTRACT

A packaging system for a pre-assembled barbeque grill having a grill housing that is collapsed relative to spaced legs, includes a shipping carton surrounding the collapsed grill housing and associated leg supports. Within the carton, end pads are positioned at opposite ends of the leg supports between the leg supports and the carton. The end pads include associated cushion elements, integral with or separate from the end pads, which extend both longitudinally and laterally beyond the leg supports. The cushioned elements are constructed to absorb shock in all directions when the carton is moved, tipped over or dropped. The end pads include associated partitions and grill component holding areas for separating and holding various grill components used with the pre-assembled barbeque grill. To keep the grill housing from moving relative to the leg supports during shipping and handling, a grill housing supporting pad is provided and further may include associated cushion elements for absorbing shock during shipping and handling.

25 Claims, 4 Drawing Sheets

PACKAGING SYSTEM FOR PRE-ASSEMBLED GAS BARBEQUE GRILL

CROSS REFERENCE TO RELATED APPLICATIONS

This application relates to co-pending patent application Ser. No. 07/526,373 filed May 21, 1990, entitled "PRE-ASSEMBLED GAS BARBEQUE GRILL", assigned to a common assignee; co-pending patent application Ser. No. 07/529,473 filed May 29, 1990 entitled "METHOD OF SHIPPING AND SET-UP OF PRE-ASSEMBLED GAS BARBEQUE GRILL", also assigned to a common assignee; and design patent application Ser. No. 542,828 filed May 18, 1990 entitled "PRE-ASSEMBLED GAS BARBEQUE GRILL", also assigned to the same assignee.

BACKGROUND OF THE INVENTION

The present invention relates to a packaging system for a pre-assembled barbeque grill including a grill housing that is collapsed relative to spaced legs for shipping, the packaging system being usable when the grill housing is located in its collapsed position to facilitate shipping and handling of the pre-assembled gas barbeque grill.

As shown in our aforementioned co-pending patent applications, a unique pre-assembled gas barbeque grill has been developed which eliminates frustrating assembly experiences and the time required to assemble barbeque grills. Our recently developed pre-assembled gas barbeque grill includes spaced leg supports which are attached to and support a grill housing. The grill housing is movable between a collapsed position relative to the leg supports for shipping, and is also being movable to an extended position relative to the leg supports during operation and use of the barbeque grill. As will be appreciated, when the grill housing is collapsed relative to the leg supports, the pre-assembled barbeque grill will be confined into a smaller predetermined volume, to facilitate placement in a shipping carton. A liquid propane tank is also positioned in the shipping carton at one end. Following purchase, the tank can be removed from the shipping carton, without removing the pre-assembled grill, for filling prior to arrival at the user's home. The pre-assembled grill is thereafter removed from the shipping carton for set-up at the user's home, including attachment of the filled tank to the grill, for immediate operation of the grill.

It is well known to use various protective cushion elements inside a shipping carton to protect the product being shipped. Where the product is a pre-assembled gas barbeque grill, as disclosed in our aforementioned co-pending patent applications, several different and unique problems must be addressed, in order to protect the pre-assembled gas barbeque grill during shipping and handling, while also enabling various grill components to be shipped with the pre-assembled barbeque grill. As can be seen in the description that follows, the unique solutions that have been developed show the that novel packaging system of the present invention not only addresses peculiar problems associated with pre-assembled gas barbeque grills, but also provide additional benefits and advantages in securing and protecting the pre-assembled gas barbeque grill, until it is opened by the ultimate consumer.

SUMMARY OF THE INVENTION

Among the several objects and advantages of the present invention include:

The provision and of a new and improved packaging system for a pre-assembled gas barbeque grill which incorporates unique and structurally inter-related features that provide a safe and secure environment for the pre-assembled gas barbeque grill;

The provision of the aforementioned packaging system including shock absorbing elements, associated with the pre-assembled gas barbeque grill within a shipping carton, which absorb or cushion the shock in all directions when the shipping carton is moved, tipped over or dropped;

The provision of the aforementioned packaging system wherein the grill housing of the pre-assembled gas barbeque grill, collapsed relative to leg supports, is protected from movement inside the shipping carton and is also cushioned against shock when the shipping carton is moved, tipped over or dropped;

The provision of the aforementioned packaging system which provides partition and holding areas for various other components used with the barbeque grill; and The provision of the aforementioned packaging system which is simple, easy to assemble to the pre-assembled gas barbeque grill on a moving assembly line, utilizes a minimum number of parts, is cost effective, and is otherwise well adapted for the purposes intended.

Briefly stated, the packaging system of the present invention is uniquely constructed for use with a pre-assembled barbeque grill having spaced leg support means and a grill housing located in collapsed position relative to the leg supports during shipping, the grill housing being subsequently movable to an extended position relative to the leg support means during operation and use of the barbeque grill. The packaging system is usable when the grill housing is located in its collapsed position and includes a carton surrounding the collapsed grill housing and associated leg support means, end pad means positioned at opposite ends of the leg support means between the leg support means and the carton, the end pad means extending both longitudinally and laterally beyond the leg support means for absorbing shock during shipping and handling, and grill housing pad means for limiting movement of the grill housing relative to the leg support means during shipping and handling.

The end pad means at opposite ends of the leg support means include spaced cushion elements which extend both laterally and longitudinally beyond the leg support means on opposite sides of the barbeque grill. Each of the spaced cushion elements are constructed to absorb shock in all directions when the carton is moved, tipped over or dropped.

At least one of the end pad means at opposite ends of the leg support means is constructed to be mounted upon and held in place on the leg support means while the barbeque grill is inserted into a shipping carton. Preferably, such construction includes openings sized to receive the leg support means and for holding the end pad means thereon.

At least one of the end pad means is associated with component partition means for separating various grill components packed within the carton and means for holding various grill components packed within the carton. One of the component holding means is configured, arranged and dimensioned to receive and hold an LP tank adjacent one end of the carton to facilitate removal of the LP tank from the carton without removing the barbeque grill. For supporting the LP tank relative to one side of the shipping carton, a tank support pad may be provided.

End pad means may be constructed to include integral cushion elements, component partition means and component holding means, or alternatively, the end pad means may include separate cushion elements, separate component partition means and separate component holding means, all of which are positioned in supporting relationship to adjacent elements or components.

The grill housing pad means includes a grill housing supporting pad with integral cushion elements for absorbing shock during shipping and handling. The grill housing supporting pad is configured, arranged and dimensioned to lock itself in place to the grill housing during assembly thereto. The grill housing support pad also cooperates with the grill housing to provide an area for a positioning grill components within the carton. The grill housing pad means includes the aforementioned grill housing supporting pad with integral cushion elements and a second grill housing support pad on an opposite side of the grill housing also including integral cushion elements for absorbing shock during shipping and handling. Also, the grill housing pad means may include a top grill housing support pad for limiting the movement of the grill housing relative to the carton.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENT

The following detailed description illustrates the invention by way of example and not by way of limitation. This description will clearly enable one skilled in the art to make and use the invention, and describes several embodiments, adaptions, variations, alternatives and uses of the invention, including what we presently believe is the best mode of carrying out the invention.

Figure 1:
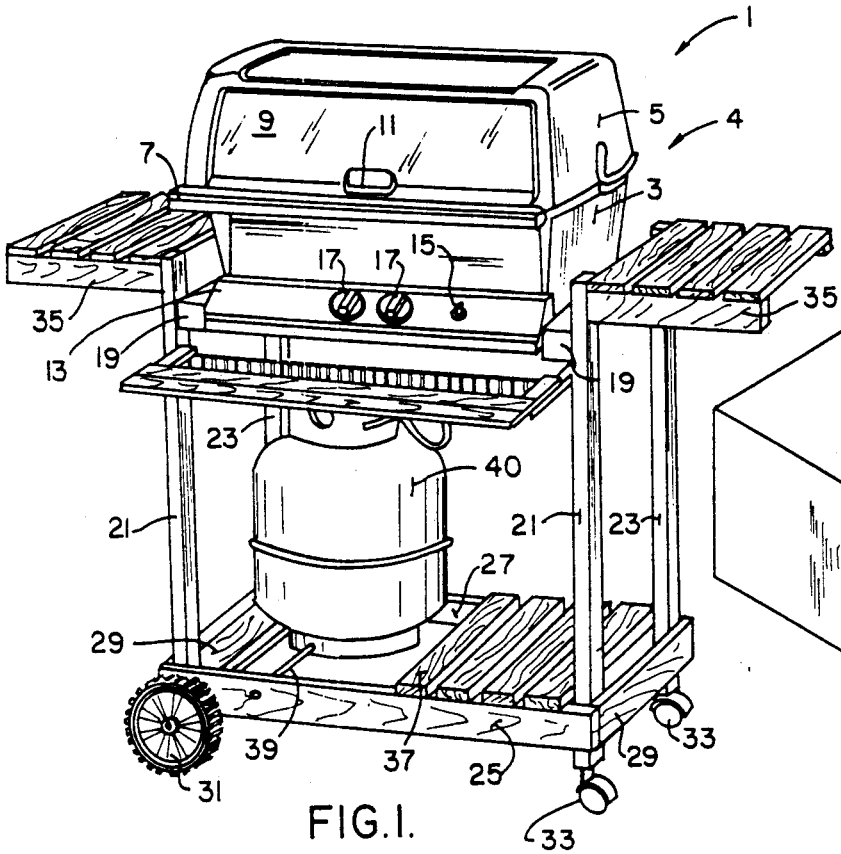
FIG. 1 is a front perspective view of the pre-assembled gas barbeque grill disclosed in our aforementioned co-pending patent applications, when fully assembled for operation and use, with supporting shelves opened up and extending in a horizontal position, for supporting various products used during grilling.

Referring first to FIG. 1 of the drawings which shows the fully assembled barbeque grill 1, it will be seen that the grill 1 includes the lower receptacle heating chamber 3 and complementary or matched dome cover 5, which are pivotally attached to one another along the rear of the grill 1 to form the grill housing 4. Dome cover 5 includes an elongated wood handle 7 secured to the front face thereof for opening and closing the dome cover 5 relative to the heating chamber receptacle 3. The dome cover 5 further includes a tempered glass window 9 for viewing the interior of the grill 1 during cooking, as well as a temperature gauge 11. Along the front face of the heating chamber receptacle 3 is a panel or strut member 13 which contains ignitor and burner controls 15, 17, respectively, for igniting the gas grill 1 and for operating same at a high, medium or low temperature, as is well known.

A pair of elongated struts 19, 19 are attached to opposite sides of the heating chamber receptacle 3 and are interconnected to one another along the front face of the grill 1 by the panel or strut member 13. Each of the elongated struts 19, 19, on opposite sides of the heating chamber receptacle 3, are attached to four leg supports including front leg supports 21, 21 and rear leg supports 23, 23. The four leg supports 21, 21 and 23, 23 are arranged in a rectangular pattern for receiving the generally rectangular shaped in cross section heating chamber receptacle 3 and the complementary matched dome cover 5.

Adjacent the bottom of the four leg supports 21, 21 and 23, 23, front and rear wood rails or struts 25, 27 interconnect side wood struts 29, 29 for structurally supporting and securing the front and rear leg supports 21, 21 and 23, 23, respectively, at the lower end of the grill. A pair of wheels 31, 31 and a pair of casters 33, 33 are positioned in the lower open end of the hollow metal front and rear leg supports 21, 21 and 23, 23 on opposite sides of the grill 1, as shown in FIG. 1. As will be apparent, the rolling wheels 31, 31 and casters 33, 33 enable the grill 1 to be moved to whatever location as desired.

Extending across the front and rear wood rails or struts 25, 27 is a bottom shelf assembly 5 including a series of wood slats 37 supporting various cooking items or utensils that may be used with the grill 1. Also extending across the front and rear struts or rails 25, 27 is a tank supporting bar 39 which supports a liquid propane tank 40 thereon. The tank 41 is attached, through a tank valve and regulator (not shown) to the gas burner assembly (also not shown) within the heating chamber receptacle 3, as is well known.

Adjacent pairs of front and rear leg supports 21, 21 and 23, 23, respectively, on opposite sides of grill 1 are provided with side shelf assemblies 35, 35 which are constructed to both fold down in proximity to the leg supports for shipping and storage, as well as being opened up to the horizontal position shown in FIG. 1 for supporting various food products, condiments, utensils, etc., used during grilling.

Figure 2:
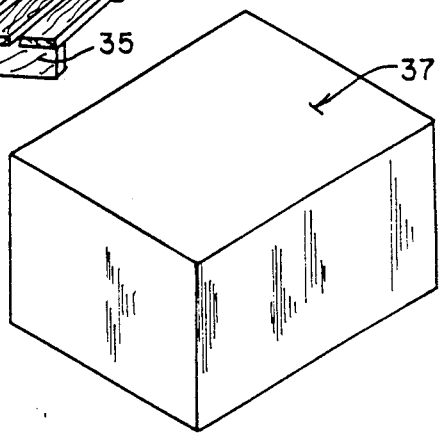
FIG. 2 is a perspective view of the shipping carton containing the pre-assembled gas barbeque grill during shipping.
Figure 3:
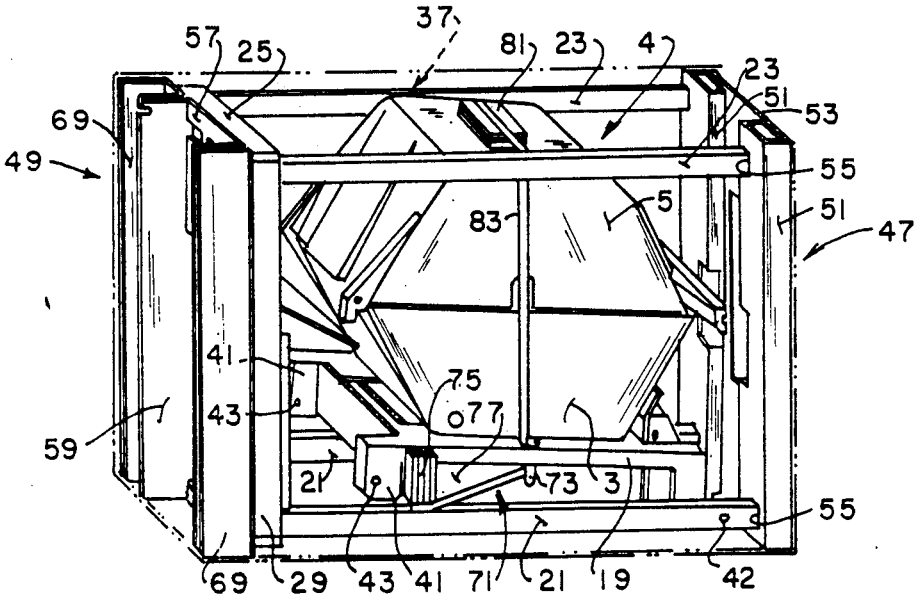
FIG. 3 is a perspective view of the pre-assembled gas barbeque grill in collapsed position relative to associated leg supports, and further showing various packaging elements or components used in supporting and securing the pre-assembled barbeque grill within the shipping carton, the shipping carton itself being shown in phantom lines.
Figure 4:
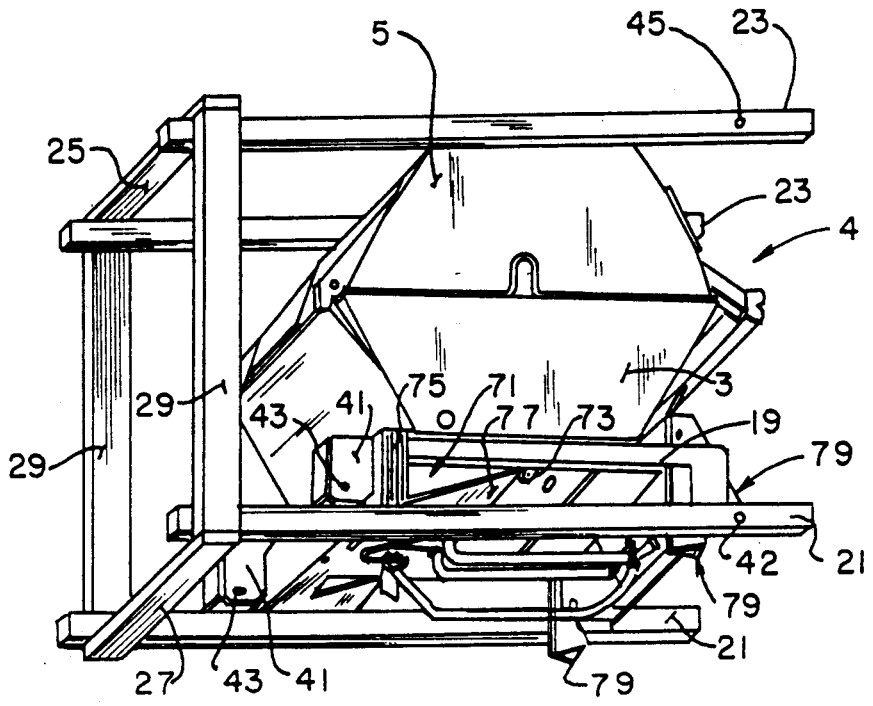
FIG. 4 is a perspective view illustrating the grill housing pad means typically associated with the grill housing for limiting movement of the grill housing relative to the leg support means within the shipping carton.

In order for the pre-assembled gas barbeque grill 1, including various components, to be contained within the shipping container 37 shown in FIG. 2 of the drawings, the grill housing 4, including the heating chamber receptacle 3 and the dome cover 5 is shown in FIGS. 3–4 of the drawings as being suspended within the four spaced front and rear leg supports 21, 21 and 23, 23, respectively. This suspended or collapsed condition results from the pivotal mounting of the grill housing 4 to the elongated struts 19, 19, on opposite sides of the heating chamber receptacle 3, as at 42, proximate an upper end of the two front leg supports 21, 21, as shown in FIGS. 3–4 of the drawings. Because the grill housing 4 is suspended from the two front leg supports 21, 21, the grill housing 4, in its lower pivot position, will be located between the four front and rear leg supports 21, 21 and 23, 23, respectively, as shown in FIGS. 3–4. As will be appreciated, this provides a more compact grill 1 for shipping within the shipping carton 37, while protecting the grill housing 4 including all associated components within the leg supports 21, 21 and 23, 23.

Although not part of the present invention, it will be understood that when it is desired to use the grill 1, the grill housing 4 is pivoted from its lower pivot position within the four front and rear leg supports 21, 21 and 23, 23, respectively and moved to an upper position where the grill housing 4 is in a substantial horizontal position, as shown in FIG. 1 of the drawings. For this purpose, the struts 19, 19 are provided with an enlarged end portion 41 having a hole 43 extending therethrough, for alignment with the hole 45 in each of the rear leg supports 23, 23, for receipt of a hinge pin (not shown) therein. When moved from its lower pivot position, as shown in FIGS. 3–4, to its upper horizontal position as shown in FIG. 1, the grill housing 4 will be held in a stable and secure position for operation and use of the grill 1.

With the above described general description of the pre-assembled gas barbeque grill 1, as more particularly described in our aforementioned co-pending patent applications, reference can now made to the packaging system which has been specifically and uniquely developed for use with the pre-assembled gas barbeque grill 1. As described above, the packaging system of the present invention is usable when the grill housing 4 is located in its lower pivot or collapsed position as shown in FIGS. 3–4 of the drawings, where the grill housing 4 is suspended or located between the front and rear leg support 21, 21 and 23, 23, respectively.

The packaging system of the present invention includes the outer shipping carton 37 shown in FIG. 2, as well as in dotted or phantom lines in FIG. 3 of the drawings. The grill housing 4, in its collapsed position, and all other components of the grill 1 are located within the shipping carton 37.

At opposite ends of the leg supports 21, 21 and 23, 23, end pads 47, 49 are provided to extend between the leg supports and the carton 37. As will be discussed in detail below, the end pads 47, 49 include portions thereof which extend both longitudinally and laterally beyond the leg supports 21, 21 and 23, 23 for absorbing shock during shipping and handling.

More specifically, the end pad 47 includes a pair of spaced cushion elements 51, 51 which are formed integral with a spanning wall 53 extending therebetween. Each of the cushion elements 51, 51 comprise foldover and reotangularly formed cushion or shock absorber supports which are adapted to be positioned in adjacent corners of the carton 37, as shown in FIG. 3. In addition, each of the cushion elements 51 include openings 55, 55, at opposite ends of each cushion element 51, for receiving the lower ends of the front and rear leg supports 21, 21 and 23, 23. The openings 55, 55 are sized for holding the end pad 47 in place on the front and rear leg supports 21, 21 and 23, 23, when the grill 1 is placed in the carton 37.

When the end pad 47 is positioned on the front and rear leg supports 21, 21 and 23, 23 as shown in FIG. 3, it will assist in maintaining the position of the leg supports during shipping while maintaining clearance of the leg supports 21, 21 and 23, 23 relative to the carton 37. Clearance is provided since the cushion elements 51, 51 are shown as extending both laterally and longitudinally beyond the front and rear leg supports 21, 21 and 23, 23. As can also be appreciated, the rectangular shaped cushion elements 51, 51 form rigid cardboard strut elements so as to add stacking strength to the shipping carton 37, from adjacent cartons 37 stacked thereon. As has also been pointed out above, the cushion elements 51, 51 absorb shock in all directions, and thereby cushion the shipping carton at one end thereof, when it is moved, tipped over or dropped on that one end. Finally, the end pad 47 serves as a separator element for grill components, such as a warming rack or the like, which can be placed between the spanning wall 53 and the grill housing 4 for packing and shipping purposes.

At the other end of the grill 1, the end pad 49 is positioned over the lower ends of the front and rear leg supports 21, 21 and 23, 23, respectively, adjacent the front and rear wood rails or struts 25, 27 and inner connecting side wood struts 29, 29 which structurally support and secure the front and rear leg supports 21, 21 and 23, 23 respectively, at the lower end of the grill 1.

Figure 7:
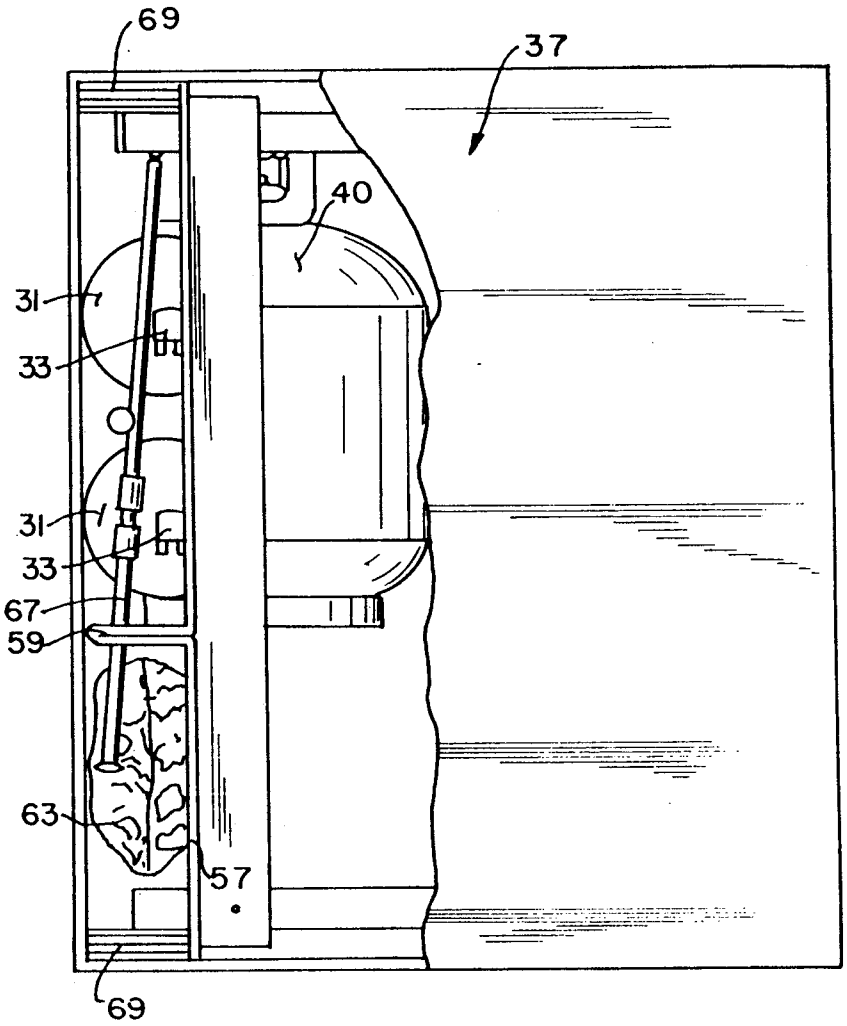
FIG. 7 is a fragmentary side elevational view of the shipping carton showing the end pad means illustrated in FIG. 6 with the LP tank, wheels, lava rocks and other grill components associated therewith.
Figure 6:
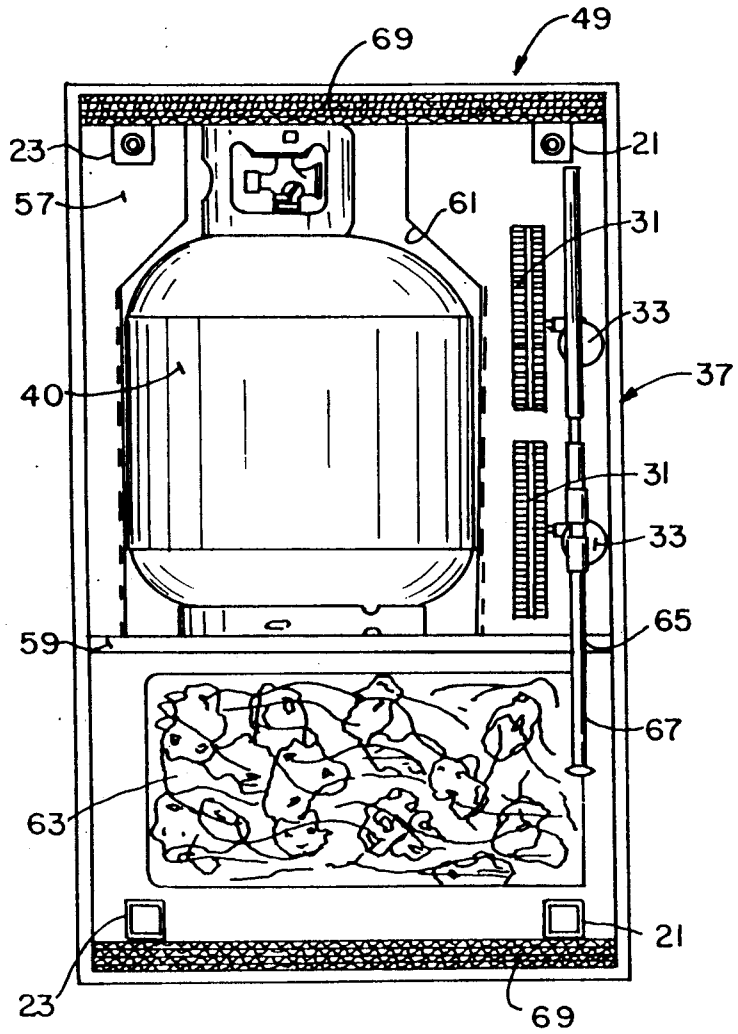
FIG. 6 is an end elevational view of the shipping carton, with one end removed, and showing the end pad means associated with one end of the pre-assembled barbeque grill including an LP tank, wheels, lava rocks, and other grill components.

The end pad 49, as best seen in FIGS. 3 and 6–7 includes a bottom wall 57 which extends across one end of the carton 37 and includes various partitions and holding areas for various grill components. For example, the partition wall 59, constituting a doubled over portion of the bottom wall 57, as best seen in FIG. 7 of the drawings, separates the various grill components from each other. Additionally, the bottom wall 57 of the end pad 49 is provided with various openings including the tank-shaped opening 61 which is configured, arranged and dimensioned to receive and hold the LP tank 40 in position adjacent one end of the shipping carton 37, to facilitate removal of the LP tank from the shipping carton 37 without removing the barbeque grill 1. As discussed in our above identified co-pending patent applications, it is very convenient for the consumer to be able to remove the LP tank from the shipping carton 37 without removing the remainder of the grill 1, allowing the user to fill the LP tank before arriving at home, and thereby enabling the user to immediately operate the grill, upon performing a few simplified steps in preparing the grill 1 for operation and use.

In addition to the opening 61, the bottom wall 57 of the end pad 49 includes openings (not shown) for receiving the spaced wheels 31, 31, casters 33, 33 and a plastic bag containing lava rock 63, on an opposite side of the partition 59 from the LP tank 40. Note further that the partition wall 59 has a slot 65 therein for receiving the shaft 67 that mounts the LP tank 40 to the grill 1, as shown in FIG. 1 of the drawings. Each of the openings for receiving the LP tank 40, wheels 31, 31, casters 33, 33 and plastic bag containing the lava rock 63 are constructed to hold such components in position during shipment.

At opposite ends of the end pad 49, between front and rear leg supports 21, 23 and 21, 23 and the shipping carton 37, are a pair of cushioning elements 69, 69 which, in addition to the bottom wall 57 and the partition 59, serve to maintain clearance of the leg supports 21, 21 and 23, 23 relative to the shipping carton 37. The corregated cushioning elements 69, 69 also serve to add stacking strength to the packaging, for adjacent stacked cartons 37.

The end pad 49 provides a cushion, through the partition 59 and bottom wall 57, to absorb shock when the carton is tipped over in all directions. Further, in conjunction with the corregated cushioning elements 69, 69, the end pad 49 provides shock absorption or cushioning of the grill 1, within the shipping carton 37, in all directions, including when moved, tipped over or dropped. Finally, the LP tank is cushioned and restrained within the opening 61 of the bottom wall 57, while also being restrained by one of the corregated cushioning elements 69 and the partition 59, as best seen in FIGS. 6–7 of the drawings.

Reference is now made to the grill housing pad means for limiting movement of the grill housing 4 relative to the leg supports 21, 21 and 23, 23 within the shipping carton 37. Specifically, the grill housing pad means includes a grill housing supporting pad 71 which extends between the enlarged end portion 41 of each elongated strut 19 and a bracket 73 which depends from the heating chamber receptacle 3. The bracket 73 is used in regulating the amount of gas to the gas burner (not shown) or may comprise any other suitable abutment extending from the heating chamber receptacle 3. The grill housing supporting pad includes an integral cushion element 75, comprising a series of folded over adjacent corregated sections which are formed as an integral part of the grill housing supporting pad 71, as shown in FIGS. 314 4. Extending between the cushion element 75 and the bracket 73 is an inclined panel 77. As will be appreciated, when the grill housing supporting pad 71 is assembled relative to the lower heating chamber receptacle 3, the free end of the inclined panel 77 engages the bracket 73 while the cushion element 75 is positioned against the enlarged end portion 41 of the elongated strut 19, on opposite sides of the grill housing 4, thus locking the grill housing support pad 71 in position. The grill housing supporting pad 71 also rests on the leg supports 21, 21, as best seen in FIGS. 3–4 of the drawings, thus preventing the grill housing 4 from swinging past its pivot point about the pins 42, 42. Cushion element 75 of the grill housing supporting pad 71 also provides a cushion to absorb shock when the unit is shipping or dropped, by transferring the weight from the grill housing 4 to the leg supports 21, 21 constituting the main frame support. It will also be seen that the grill housing supporting pad 71, between the inclined wall 77 and the bottom of the grill housing 4, provides an area for positioning other grill components, as may be desired.

Figure 5:
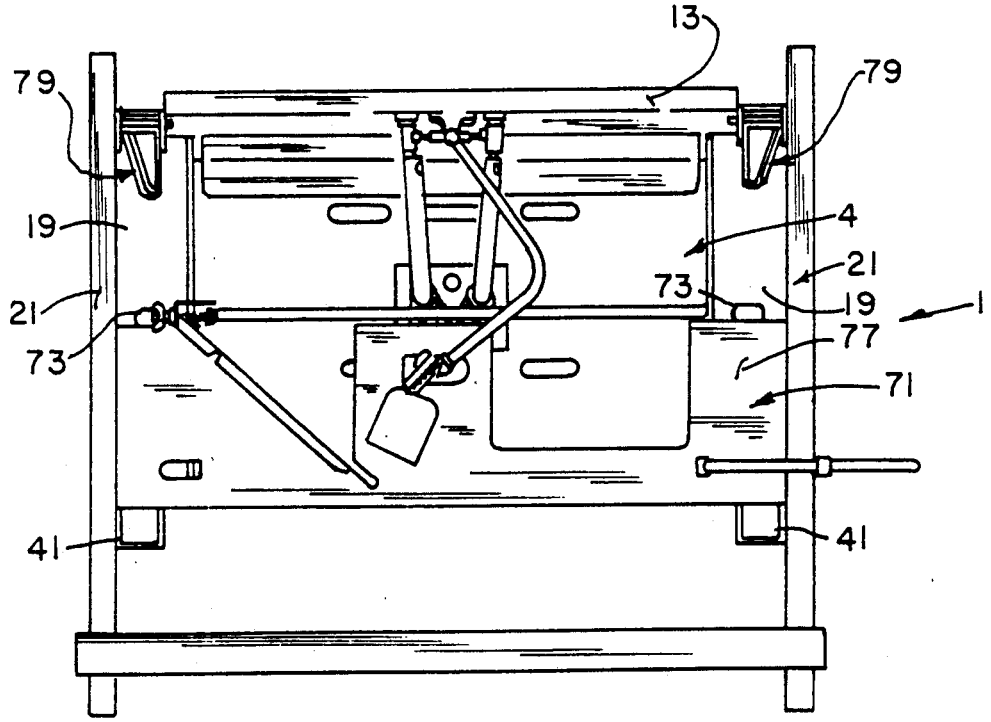
FIG. 5 is a bottom plan view of the collapsed grill housing within the leg support means and further illustrating the grill housing pad means which limit movement of the grill housing relative to the spaced leg supports.

The grill housing pad means may further include a second grill housing supporting pad 79 which is inserted in the area between the elongated struts 19 and the controlled panel 13, on opposite sides of the grill housing 4, as best seen in FIGS. 3–5 of the drawings. Each second grill housing supporting pad 79 comprises a one-piece element having a generally triangular shape which serves to absorb the shock of the grill when it is tipped over on the grill housing support side of the carton 37.

In addition to the first and second grill housing supporting pad 71 and 79, it will be noted that the grill housing pad means may further include a top grill housing supporting pad 81, as shown in FIG. 3, which is secured to the top of the dome cover 5 by the encircling band 83, which is used to keep the chamber receptacle 3 and the dome cover 5 from opening during shipment. The top grill housing supporting pad 81 serves to fill the space between the top of the grill housing and the shipping carton 37 to limit movement of the grill housing 4 during handling and shipping. Thus, it can be seen that a shipping carton 37, with the end pad means 47 and 49, and the grill housing pad means including the first and second grill housing supporting pads 71 and 79, together with the top grill housing supporting pad 81, provides a unique packing system for the pre-assembled barbeque grill 1.

Figure 9:
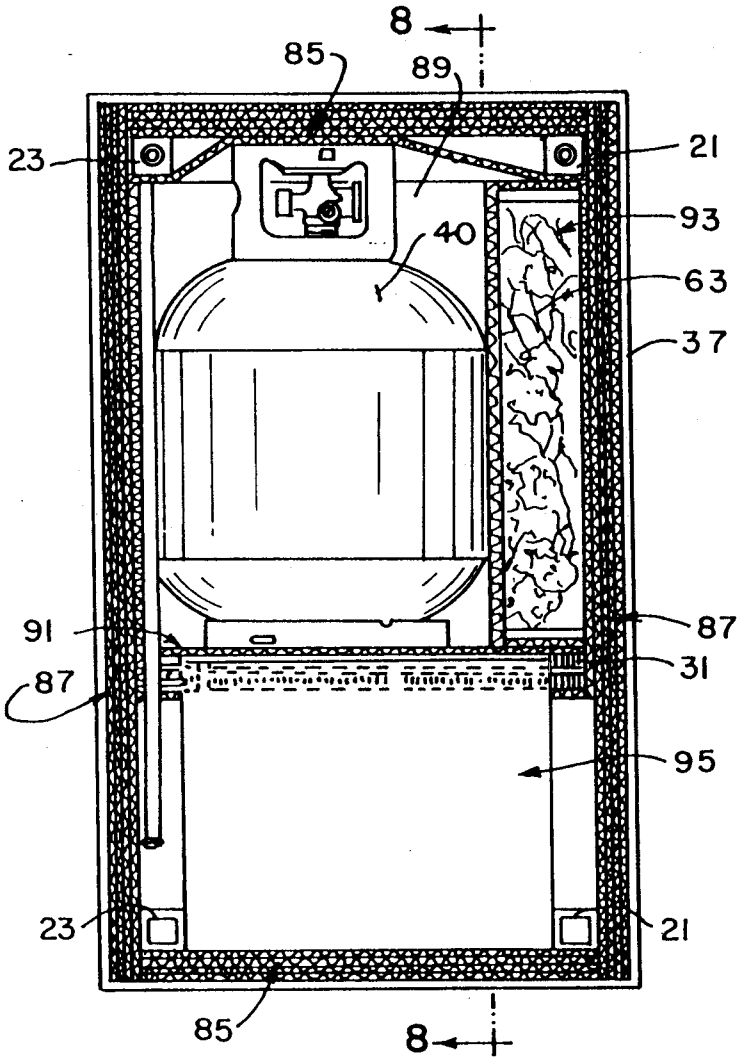
FIG. 9 is an end elevational view further illustrating the separate cushion elements, separate component partitioning means and separate component holding means in the alternative construction of end pad means at one end of the shipping carton.
Figure 8:
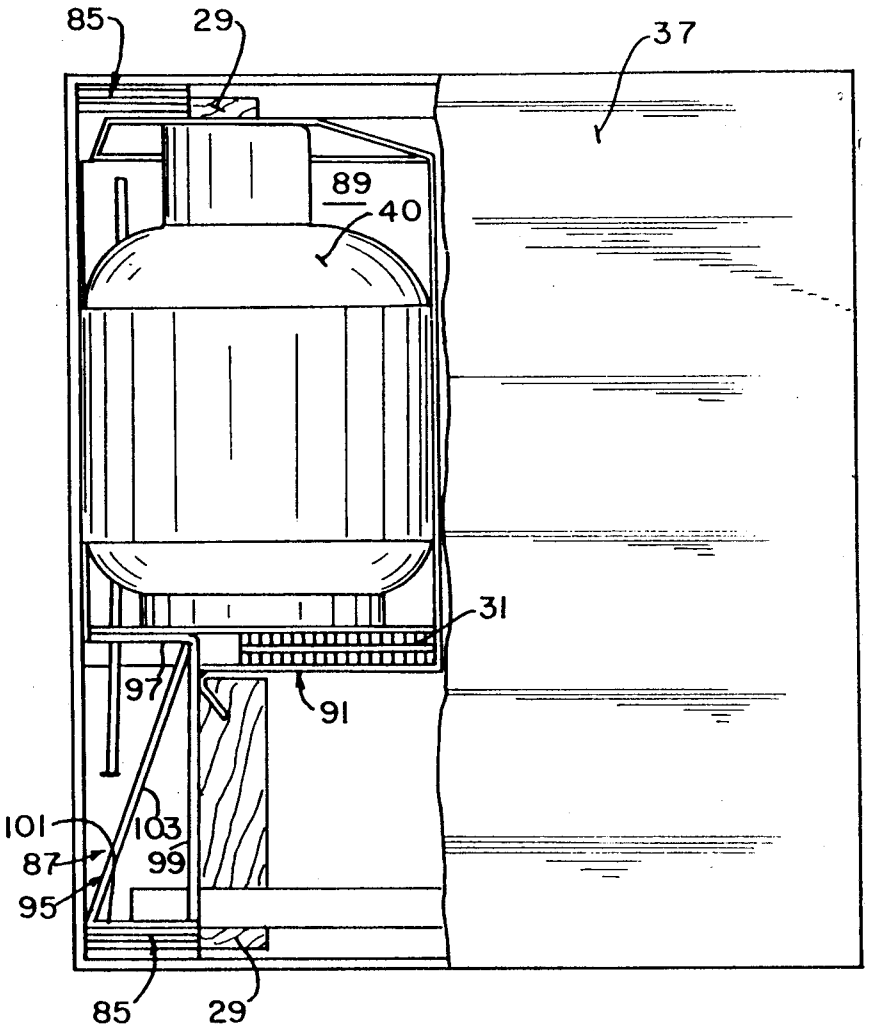
FIG. 8 is a fragmentary side elevational view of the shipping carton and illustrating, at one end of the carton, separate cushion elements, separate component partitioning means and separate component holding means, all of which are positioned in supporting relationship to adjacent elements or components, thus forming an alternate method end pad supporting means.

Reference is now made to FIGS. 8–9 of the drawings for an alternative packaging construction for that end of the shipping carton 37 associated with the LP tank 40 and other related components. As shown in FIGS. 8–9, the end pad means for the tank end part of the shipping carton 37 includes a pair of spaced corrugated cushion elements 85, 85 at opposite ends of the shipping carton which underlie the side rails 29, 29 at the lower ends of the leg supports 21, 21 and 23, 23. In addition, there are a pair of spaced side corrugated cushion elements 87, 87 which underlie the front and rear rails 25, 27, and which are positioned between the leg supports and the shipping carton 37, as are the spaced corregated elements 85, 85. This is best seen in FIG. 9 of the drawings where the spaced end cushion elements 85, 85 and side cushion elements 87, 87 are positioned between the leg supports 2!, 21 and 23, 23 and the shipping carton 37 and contact one another in the area of the corners of the shipping carton 37. The purpose of the end and side cushion elements 85, 85 and 87, 87, respectively, are to maintain the space between the leg supports and the shipping carton 37 as well as provide added strength to the shipping carton, while providing protection to the grill 1 when it is moved, tipped over or dropped.

Note that the alternate packaging end pad means in FIGS. 8–9 also provides a tank carton 89 for receiving the LP tank. Note further that the tank end carton 89 is located inside of the spaced leg supports 21, 21 and 23, 23 to provide an open end to the end of the shipping carton 37 to enable the LP tank to be removed, without removing the grill 1. The tank carton 89 also provides protection of the LP tank from the grill housing 4, as will be appreciated.

The wheel and caster compartment 91 is located at the bottom of the LP tank 40 so as to provide a compartment with protection for the wheels 31, 31 and casters 33, 33.

As best seen in FIG. 9 of the drawings, a lava rock pad and compartment 93 is located between the LP tank and the shipping carton 37, along one side thereof. The purpose of the lava rock pad and compartment 93 is to provide a compartment for the lava rock.

In order to support the LP tank 40, a tank support pad 93 is provided. As shown in FIG. 8 of the drawings, the tank support pad includes a horizontal wall 97 to align the LP tank 40, an integral vertical wall 99, a second horizontal wall 101 connected to the bottom of the vertical wall 99, and an inclined wall 103 which extends between lower horizontal wall 101 and the intersection between the upper horizontal wall 97 and a vertical wall 91 to provide support for the LP tank. As will be understood, this will limit movement of the tank, as well as absorbing shock of the LP tank 40 when the shipping carton is moved, tipped over or dropped on its side.

From the foregoing, it will now be appreciated that the packaging system of the present invention provides a unique construction which is peculiarly adapted for a pre-assembled gas barbeque grill where the grill housing is collapsed or suspended relative to associated leg supports during shipping. By absorbing shock in all directions as well as preventing movement of the grill housing relative to the leg supports within the shipping carton and providing partitions and compartments for various other grill components, the packaging system of the present invention functions to achieve the various objects and features of this invention, as well as providing other advantageous results.

As various changes could be made in the above constructions without departing from the scope of the invention, it is intended that all matter contained in the above description or shown in the accompanying drawings shall be interpreted as illustrative and not in a limiting sense.

We claim:

1. A packaging system for a pre-assembled barbeque grill having spaced leg supports and a grill housing located in a collapsed position relative to said leg supports during shipping, said grill housing subsequently movable to an extended position relative to said leg supports during operation and use of the barbeque grill, said packaging system being usable when said grill housing is located in its collapsed position and including:

a carton surrounding the collapsed grill housing and associated leg supports;

separate end pad means positioned at opposite ends of said leg supports between said leg supports and said carton, each said separate end pad means extending both longitudinally and laterally beyond said leg supports for absorbing shock during shipping and handling; and grill housing pad means independent of each said separate end pad means for limiting movement of said grill housing relative to said leg supports in the shipping carton during shipping and handling.

2. The packaging system as defined in claim 1 wherein the end pad means at opposite ends of said leg supports includes spaced cushion elements which extend both laterally and longitudinally beyond said leg supports on opposite ends of said barbeque grill.

3. The packaging system as defined in claim 2 wherein each of the spaced cushion elements are constructed to absorb shock in all directions when the carton is moved, tipped over or dropped.

4. The packaging system as defined in claim 3 wherein at least one of the end pad means is constructed to be mounted upon and held in place on said leg supports while the barbeque grill is inserted into a shipping carton.

5. The packaging system as defined in claim 4 wherein at least one of the end pad means includes openings sized to receive the leg supports and for holding the end pad means thereon.

6. The packaging system as defined in claim 1 wherein at least one of the end pad is associated with component partition means for separating various grill components packed within the carton.

7. The packaging system as defined in claim 6 wherein at least one of the end pad means is also constructed to provide means for holding various grill components packed within the carton.

8. The packaging system as defined in claim 7 wherein at least one of the end pad means includes integral cushion elements, component partition means for portioning components and component holding means for holding components.

9. The packaging system as defined in claim 7 wherein at least one of the end pad means includes separate cushion elements, separate component partition means for portioning components and separate component holding means for holding components, all of which are positioned in supporting relationship to one another.

10. The packaging system as defined in claim 9 wherein one of the component holding means is configured, arranged and dimensioned to receive and hold an LP tank adjacent one end of the carton to facilitate removal of the LP tank from the carton without removing the barbeque grill.

11. The packaging system as defined in claim 10 and further including a tank support pad between the LP tank and one side of the carton.

12. The packaging system as defined in claim 1 wherein said grill housing pad means includes a grill housing supporting pad with integral cushion elements for absorbing shock during shipping and handling.

13. The packaging system as defined in claim 12 wherein the grill housing supporting pad is configured, arranged and dimensioned to lock itself in place to the grill housing during assembly thereto.

14. The packaging system as defined in claim 13 wherein the grill housing support pad cooperates with the grill housing to provide an area for positioning grill components within the carton.

15. The packaging system as defined in claim 12 wherein the grill housing pad means further includes a second grill housing supporting pad on an opposite side of said grill housing also including integral cushion elements for absorbing shock during shipping and handling.

16. The packaging system as defined in claim 15 and further including a top grill housing supporting pad for limiting the movement of the grill housing relative to the carton.

17. A packaging system for a pre-assembled barbeque grill having spaced leg supports and a grill housing located in a collapsed position relative to said leg support means during shipping, said grill housing subsequently movable to an extended position relative to said leg supports during operation and use of the barbeque grill, said packaging system being usable when said grill housing is located in its collapsed position and including:

a carton surrounding the collapsed grill housing and associated leg supports;

separate end pad means positioned at opposite ends of said leg supports between said leg supports and said carton, said end pad means extending both longitudinally and laterally beyond said leg support for absorbing shock during shipping and handling and including associated cushioning elements; and grill housing pad means independent of each said separate end pad means for limiting movement of said grill housing relative to said leg supports in the shipping carton during shipping and handling.

18. The packaging system as defined in claim 17 wherein each separate end pad means includes spaced cushion elements which are positioned adjacent corners of said carton and are constructed to absorb shock in all directions when the carton is moved, tipped over or dropped.

19. The packaging system as defined in claim 18 wherein the associated cushion elements are integrally connected to said end pad means.

20. The packaging system as defined in claim 19 wherein the associated cushion elements are separate from other elements forming the end pad means.

21. The packaging system as defined in claim 20 wherein the end pad means also includes separate grill component partition means for portioning grill components and separate grill component holding means for holding components.

22. The packaging system as defined in claim 19 wherein the end pad means also includes integral grill component partition means for portioning components and integral grill component holding means for holding components.

23. The packaging system as defined in claim 17 wherein the grill housing pad means includes a grill housing supporting pad with integral cushion elements for absorbing shock during shipping and handling.

24. The packaging system as defined in claim 23 wherein the grill housing pad means includes a second grill housing supporting pad on a side of said grill housing opposite said integral cushion elements for absorbing shock during shipping and handling.

25. A packaging system for a pre-assembled barbeque grill having spaced leg supports and a grill housing located in a collapsed position relative to said leg supports during shipping, said grill housing subsequently movable to an extended position relative to said leg supports during operation and use of the barbeque grill, said packaging system being usable when said grill housing is located in its collapsed position and including:

a carton surrounding the collapsed grill housing and associated leg supports;

separate end pad means positioned at opposite ends of said leg support means between said leg supports and said carton, each said separate end pad means extending both longitudinally and laterally beyond said leg supports for absorbing shock during shipping and handling and including spaced cushioning elements associated with each separate end pad means, the spaced cushion elements of each separate end pad means being positioned in adjacent corners of said carton and being constructed to absorb shock in all directions when the carton is moved, tipped over or dropped; and grill housing pad means independent of each said separate end pad means for limiting movement of said grill housing relative to said leg supports in the shipping carton during shipping and handling, said grill housing pad means also including associated cushion elements for absorbing shock during shipping and handling.

* * * * *